US009468268B2

(12) United States Patent
Chien

(10) Patent No.: US 9,468,268 B2
(45) Date of Patent: Oct. 18, 2016

(54) WEARABLE ELECTRONIC DEVICE

(71) Applicant: Acer Incorporated, New Taipei (TW)

(72) Inventor: Yu-Hsiu Chien, New Taipei (TW)

(73) Assignee: Acer Incorporated, New Taipei (TW)

( * ) Notice: Subject to any disclaimer, the term of this patent is extended or adjusted under 35 U.S.C. 154(b) by 26 days.

(21) Appl. No.: 14/595,215

(22) Filed: Jan. 13, 2015

(65) Prior Publication Data

US 2016/0081438 A1 Mar. 24, 2016

(30) Foreign Application Priority Data

Sep. 24, 2014 (TW) ..... 103132999 A

(51) Int. Cl.

| | |
|---|---|
| ***A44C 5/00*** | (2006.01) |
| ***A44C 5/14*** | (2006.01) |
| ***A45C 5/00*** | (2006.01) |
| *A45F 5/00* | (2006.01) |

(52) U.S. Cl.

CPC . *A44C 5/14* (2013.01); *A44C 5/00* (2013.01); *A44C 5/0007* (2013.01); *A45C 5/00* (2013.01); *A45F 2005/008* (2013.01)

(58) Field of Classification Search

CPC ..... A44C 5/00; A44C 5/0007; A44C 5/14; A44C 5/0053; A44C 5/0061; G04B 37/12; A45F 2005/008

USPC ..... 224/267, 152, 164, 165, 166, 174

See application file for complete search history.

(56) References Cited

U.S. PATENT DOCUMENTS

| | | | | |
|---|---|---|---|---|
| 1,818,637 A * | 8/1931 | Mathez | G04B 37/12 | 224/179 |
| 2,124,945 A * | 7/1938 | Gross | A45C 15/08 | 224/152 |
| 4,326,321 A * | 4/1982 | Colognori | A44C 5/14 | 16/229 |
| 6,176,612 B1 * | 1/2001 | Chagnoux | A44C 5/14 | 224/168 |
| 6,179,177 B1 * | 1/2001 | Hihara | A44C 5/145 | 224/164 |
| 7,380,979 B2 * | 6/2008 | Hiranuma | A44C 5/14 | 224/180 |
| 7,703,974 B2 * | 4/2010 | Bouille | A44C 5/14 | 224/164 |
| 8,240,011 B2 * | 8/2012 | Chevrolet | A44C 5/14 | 24/265 B |

FOREIGN PATENT DOCUMENTS

| | | |
|---|---|---|
| CN | 202842558 | 4/2013 |
| CN | 202854492 | 4/2013 |

* cited by examiner

*Primary Examiner* — Justin Larson

*Assistant Examiner* — Lester L Vanterpool

(74) *Attorney, Agent, or Firm* — Jianq Chyun IP Office

(57) ABSTRACT

A wearable electronic device including a base, a body, two linking assemblies, and a wearable element is provided. The base has a carrier and two pivoting portions located at two opposite sides of the carrier, wherein each of the pivoting portions has two first contact points disposed opposite to each other and two second contact points disposed opposite to each other. The body is disposed on the carrier. The wearable element has two opposite end portions, wherein each of the linking assemblies passes through the corresponding end portion and each of the end portions of the wearable element is coupled to the two first contact points of the corresponding pivoting portion through the corresponding linking assembly. When the base is subjected to an external force, at least one of the linking assemblies moves from the two first contact points to the two second contact points of the corresponding pivoting portion.

9 Claims, 8 Drawing Sheets

WEARABLE ELECTRONIC DEVICE

CROSS-REFERENCE TO RELATED APPLICATION

This application claims the priority benefit of Taiwan application serial no. 103132999, filed on Sep. 24, 2014. The entirety of the above-mentioned patent application is hereby incorporated by reference herein and made a part of this specification.

BACKGROUND OF THE INVENTION

1. Field of the Invention

The invention generally relates to a wearable device, and more particularly, to a wearable electronic device.

2. Description of Related Art

In recent years, with the rapid development of mobile communication technology, many related technology products have continue to emerge, wherein wearable electronic device is characterized in having compact size, easy to carry, and etc., and may usually be worn on a wrist, arm or other suitable parts of human body to perform operation, and thus is gradually favored by consumers. Hence, most vendors become actively involved in the research and development of such related products.

Taking a Smart Watch or Bracelet for an example of the wearable electronic device, as being different from commonly seem Smart Phone or Tablet PC, a main appeal of the Smart Watch or Bracelet is being wearable by a user, and thus, in terms of design consideration thereof, such as appearance, size and weight, comfortableness in wearing the Smart Watch or Bracelet must be taken into account. As such, physical keys or a touch display screen, which is used as a human-machine interface on the Smart Watch or Bracelet, is usually smaller than that of the commonly seem Smart Phone or Tablet PC. As being limited by the size, regardless the Smart Watch or Bracelet is being operated through either the physical keys or virtual buttons of the touch display screen, the user may feel inconvenience in use or may cause inadvertent operation. Therefore, if the Smart Watch or Bracelet may be supplementarily operated by simple actions (such as gestures), then it would undoubtedly be a great boon for the user.

SUMMARY OF THE INVENTION

The invention is directed to a wearable electronic device having favorable convenience of use.

The invention provides a wearable electronic device including a base, a body, two linking assemblies, and a wearable element. The base has a carrier and two pivoting portions located at two opposite sides of the carrier, wherein each of the pivoting portions has two first contact points disposed opposite to each other and two second contact points disposed opposite to each other. The body is disposed on the carrier. The wearable element has two opposite end portions, wherein each of the linking assemblies passes through the corresponding end portion, and each of the end portions of the wearable element is coupled to the two first contact points of the corresponding pivoting portion through the corresponding linking assembly. When the base is subjected to an external force, at least one of the linking assemblies moves from the two first contact points to the two second contact points of the corresponding pivoting portion.

In view of the foregoing, the wearable electronic device of the invention may use the linking assemblies to couple the wearable element to the pivoting portions of the base, wherein after the base of the wearable electronic device is subjected to the external force, the base would actuate relative to the wearable element so as to enable the linking assemblies to move from the first contact points disposed opposite to each other to second contact points disposed opposite to each other on the pivoting portions. At this moment, the conductive terminals within the second contact points disposed opposite to each other may be electrically conducted due to being connected by the linking assemblies, and may simultaneously generate an electrical signal. Moreover, since the conductive terminals are electrically connected with the body, the electrical signal may be transmitted to the body, so that a processing unit within the body may output a control signal according to the electrical signal for executing functions, such as power switching, volume adjustment, screen switching, video image recording, sound recording, or Bluetooth device searching and matching. As a result, in addition to operating the wearable electronic device through using physical keys or virtual buttons, a user may also statically or dynamically operate the wearable electronic device easily through using gesture changes or postural changes of other wearing parts, thereby enhancing the flexibility and the convenience in use.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
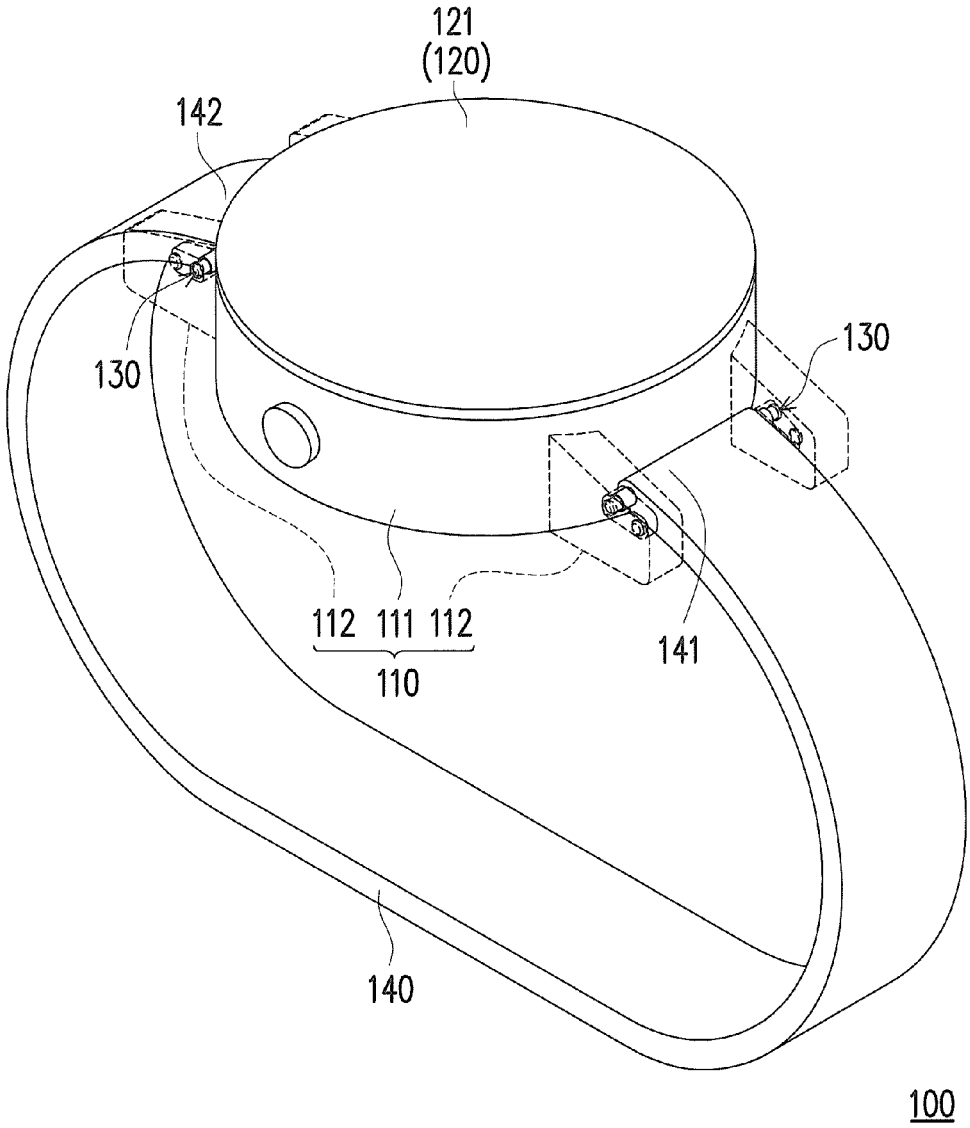
FIG. 1 is a schematic diagram illustrating a wearable electronic device according to an embodiment of the invention.
Figure 2:
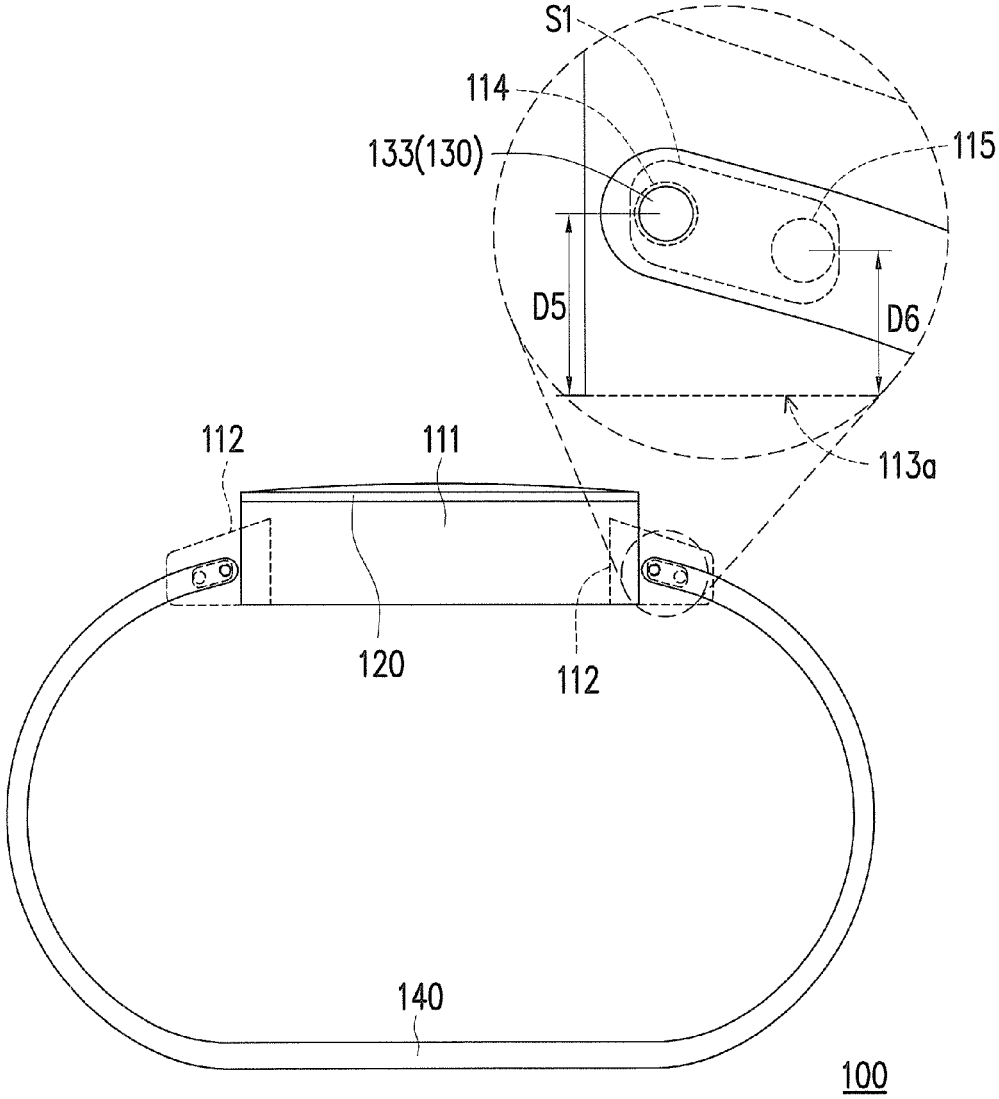
FIG. 2 is a side view of the wearable electronic device shown in FIG. 1.
Figure 3:
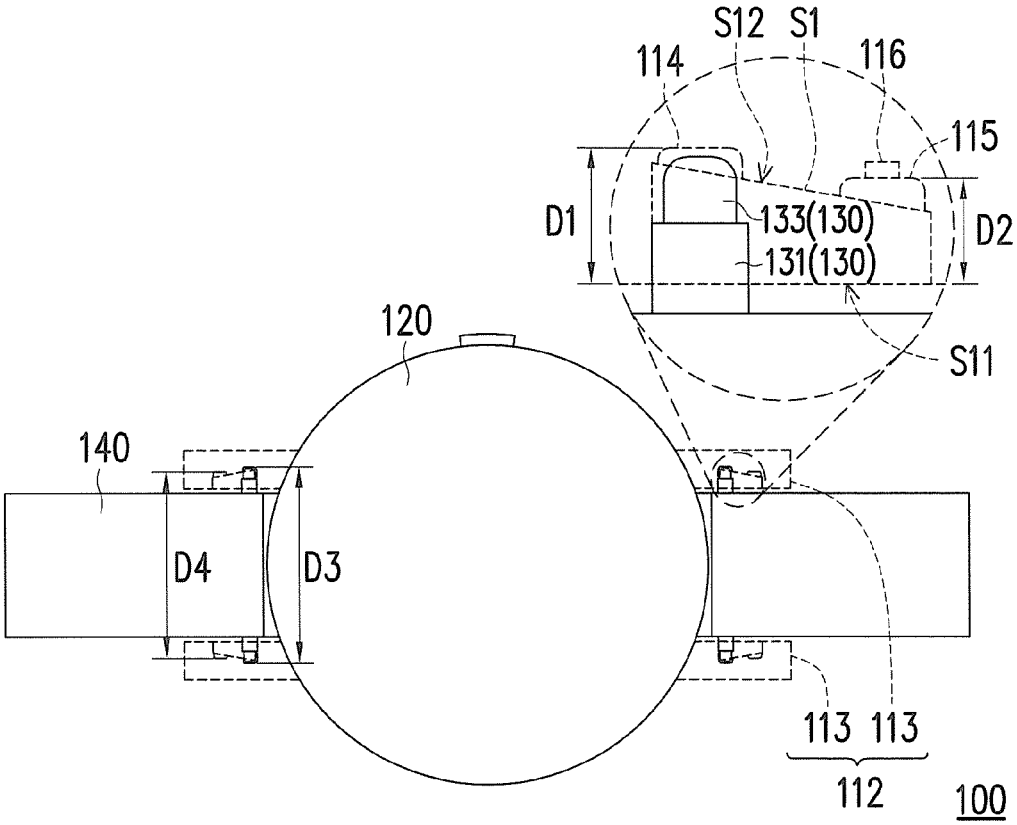
FIG. 3 is a top view of the wearable electronic device shown in FIG. 1.

FIG. 1 is a schematic diagram illustrating a wearable electronic device according to an embodiment of the invention. FIG. 2 is a side view of the wearable electronic device shown in FIG. 1. FIG. 3 is a top view of the wearable electronic device shown in FIG. 1. Referring to FIG. 1 through FIG. 3, in the present embodiment, a wearable electronic device 100 is, for example, a Smart Watch or Bracelet that is suitable for being worn on a user's wrist or arm, but the invention is not limited thereto. For instance, the wearable electronic device 100 may also be worn on the user's neck or ankle.

The wearable electronic device 100 may include a base 110, a body 120, two linking assemblies 130 and a wearable element 140, wherein the base 110 may be formed of metal, plastic, acrylic, carbon fiber, composite materials, or other suitable material. Herein, the base 110 may have a carrier 111 and two pivoting portions 112, wherein the two pivoting portions 112 are located at two opposite sides of the carrier 111 and respectively have two first contact points 114 disposed opposite to each other and two second contact points 115 disposed opposite to each other. Specifically, each of the pivoting portions 112 is, for example, composed of two ribbed plates 113 that are disposed symmetrically and parallel to each other, wherein each of the two ribbed plates 113 protrudes out of an exterior wall of the carrier 111 and has one first contact point 114 and one second contact points 115 that are disposed corresponding to each other in a set. On the other hand, each of the ribbed plates 113 may has a sliding rail S1, wherein the first contact point 114 and the second contact point 115 in a same set are located in the same sliding rail S1, and the second contact point 115 is farther away from the carrier 111 than the first contact point 114.

In the present embodiment, each of the sliding rails S1 has an opening S11 and a guiding slope S12 opposite to the opening S11, wherein each of the guiding slopes S12 is connected with the corresponding first contact point 114 and the corresponding second contact point 115, and a distance D1 between the first contact point 114 and the opening S11 is greater than a distance D2 between the second contact point 115 and the opening S11. From another perspective, a distance D3 between the two first contact points 114 disposed opposite to each other is greater than a distance D4 between the two second contact points 115 disposed opposite to each other. On the other hand, a distance D5 between each of the first contact points 114 and a bottom surface 113*a* of the ribbed plate 113 is greater than a distance D6 between each of the second contact points 115 and the bottom surface 113 of the ribbed plate 113, namely, each of the sliding rails S1 is, for example, extends from the corresponding first contact point 114 towards the bottom surface 113*a* of the ribbed plate 113 and obliquely downwards to the second contact point 115.

The body 120 is disposed on the carrier 111 and may include a display screen 121 exposed from the carrier 111, wherein the display screen 121 may have a touch function for being used as a user operation interface of the wearable electronic device 100. On the other hand, the wearable element 140 has a first end portion 141 and a second end portion 142 opposite to each other, wherein one of the linking assemblies 130 may penetrate through the first end portion 141 while the other one of the linking assemblies 130 may penetrate through the second end portion 142. Herein, the first end portion 141 and the second end portion 142 of the wearable element 140 may respectively be coupled to two first contact points 114 of the corresponding pivoting portion 112 through the corresponding linking assembly 130. In general, the wearable element 140 may be a rubber strap, a metal strap, an elastic strap, or a strap a made of other suitable material, but the invention is not limited thereto.

Figure 4:
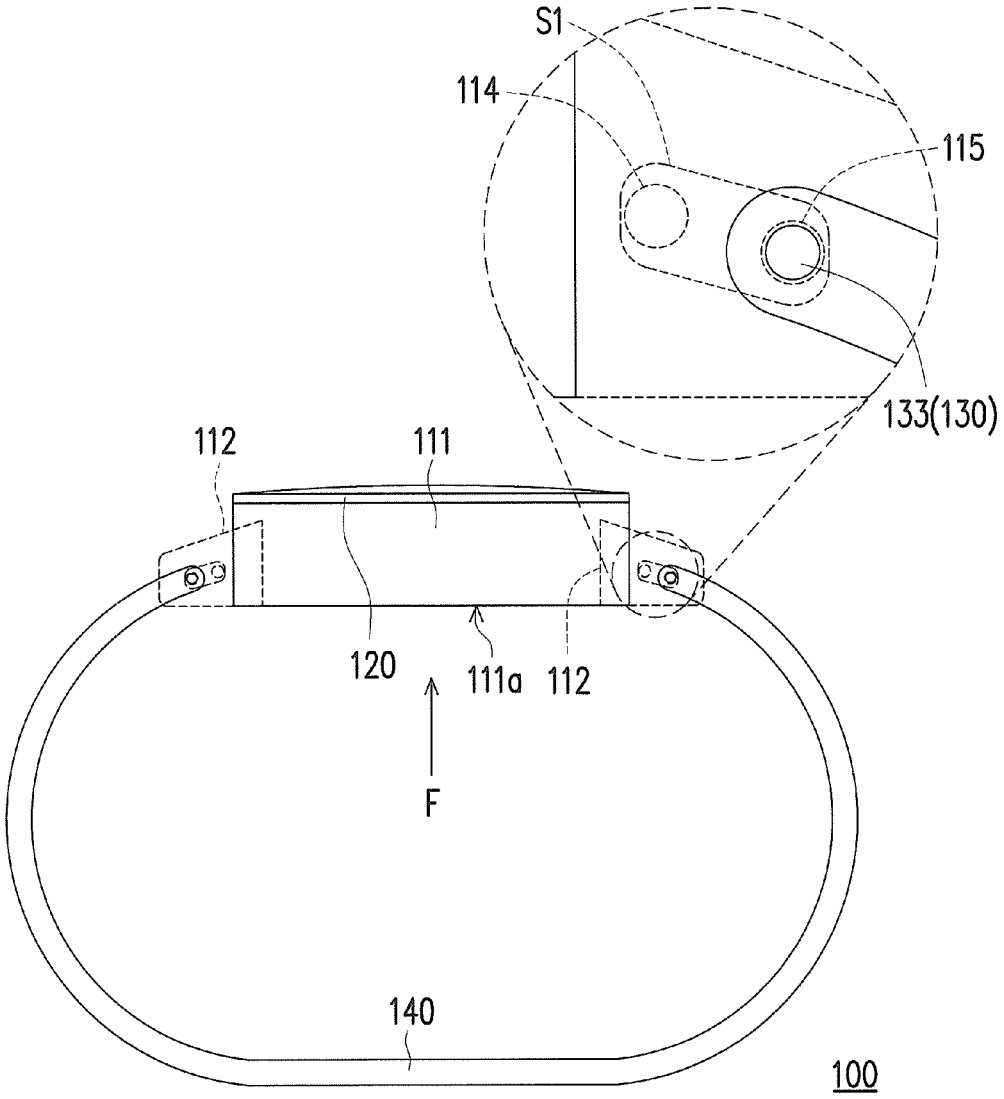
FIG. 4 is a side view of the wearable electronic device shown in FIG. 2 after it is subjected to an external force.
Figure 5:
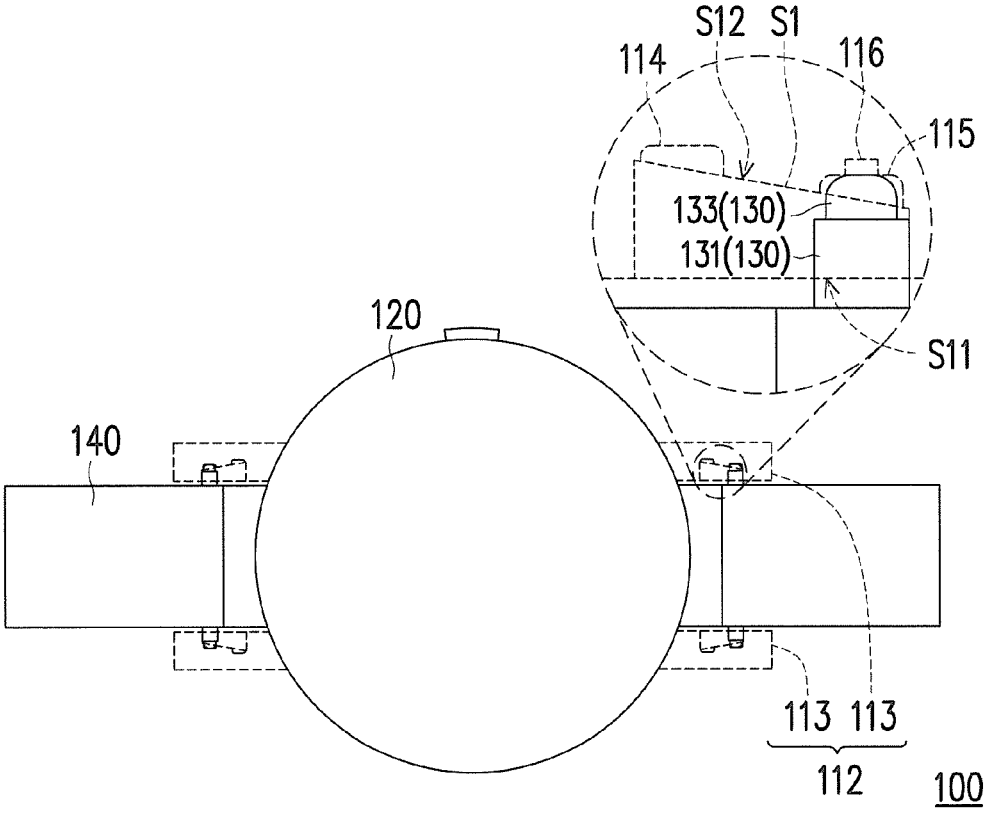
FIG. 5 is a top view of the wearable electronic device shown in FIG. 4.

FIG. 4 is a side view of the wearable electronic device shown in FIG. 2 after it is subjected to an external force. FIG. 5 is a top view of the wearable electronic device shown in FIG. 4. Referring to FIG. 2 through FIG. 5, since the sliding rail S1, for example, extends from the first contact point 114 towards the bottom surface 113*a* of the ribbed plate 113 and obliquely downwards to the second contact point 115, when the bottom of the base 110 is subjected to an external force F (such that when the user pushes the bottom surface 111*a* of the carrier 111 by the wrist or other wearing parts), the base 110 would actuates relative to the wearable element 140, so that each of the linking assemblies 130 may be guided by the sliding rail S1 to move from the two first contact points 114 to the two second contact points 115 of the corresponding pivoting portion 112. On the other hand, each of the second contact points 115 may be disposed with a conductive terminal 116 electrically coupled to the body 120 therein, but the invention is not limited thereto. In other embodiment, two conductive terminals 116 may be chosen to respectively being disposed in any two second contact points 115 that are disposed opposite to each other.

When each of the linking assemblies 130 moves from the two first contact points 114 to the two second contact points 115 of the corresponding pivoting portion 112, the two conductive terminals 116 within the two second contact points 115 of the pivoting portion 112 may be electrically conducted due to being connected by the each of the linking assemblies 130, and may simultaneously generate an electrical signal. Moreover, since the conductive terminals 116 and the body 120 are electrically connected, the electrical signal may be transmitted to the body 120, so that a corresponding process unit (not shown) within the body 120 may output a control signal according to the electrical signal for executing functions, such as power switching, volume adjustment, screen switching, video image recording, sound recording, or Bluetooth device searching and matching. As a result, in addition to operating the wearable electronic device 100 through using physical keys or virtual buttons, the user may also statically or dynamically operate the wearable electronic device 100 easily through using gesture changes or postural changes of other wearing parts thereby enhancing the flexibility and the convenience in use.

Figure 6:
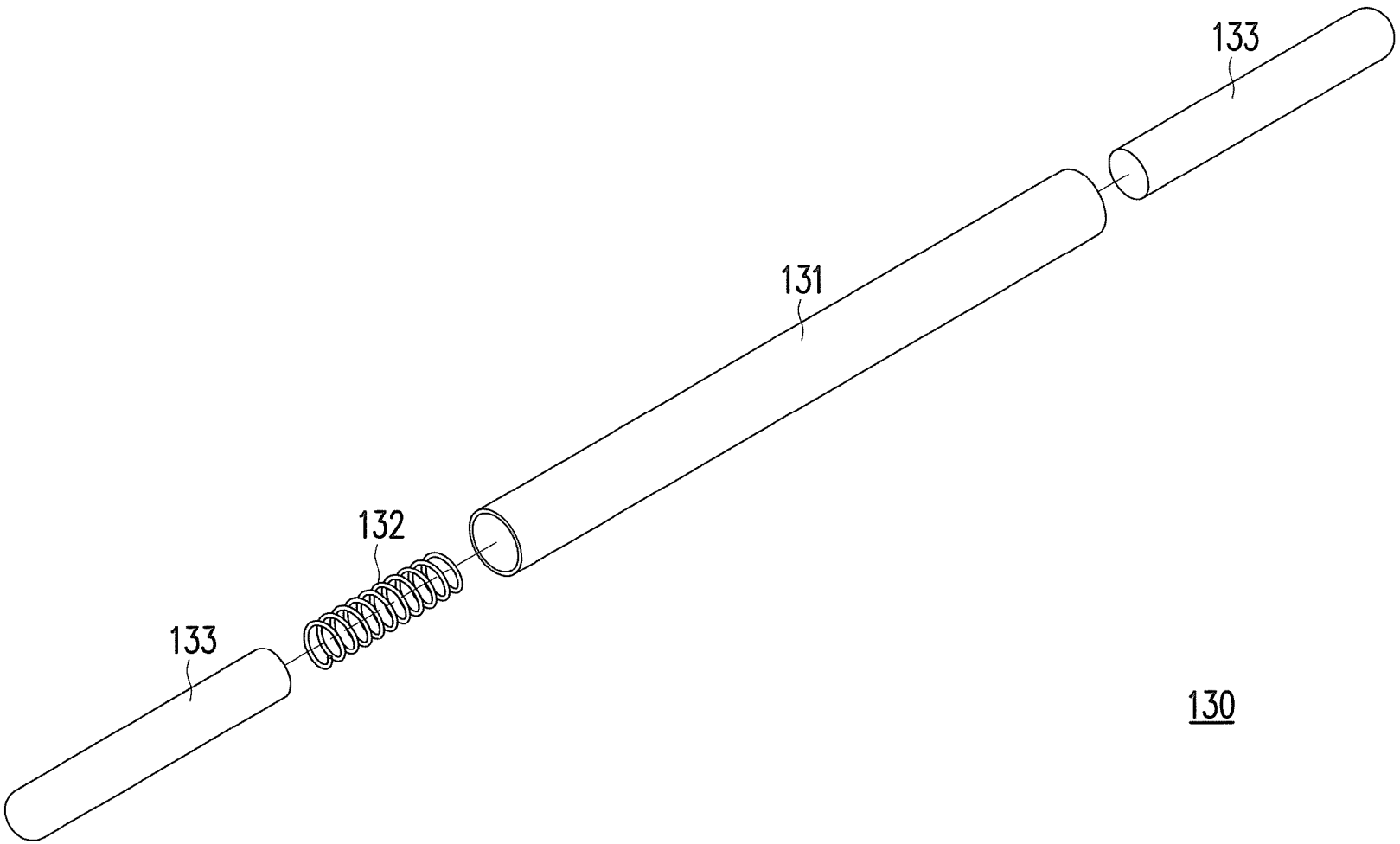
FIG. 6 is a schematic exploded view of a linking assembly shown in FIG. 1.

FIG. 6 is a schematic exploded view of a linking assembly shown in FIG. 1. Referring to FIG. 2 through FIG. 6, in the present embodiment, each of the linking assemblies 130 may include a sleeve 131, an elastic member 132 and two rods 133, wherein the sleeve 131, the elastic member 132 and the two rods 133 are, for example, formed by conductive metals, so that when each of the linking assemblies 130 moves from the two first contact points 114 to the two second contact points 115 of the corresponding pivoting portion 112, the two conductive terminals 116 within the two second contact points 115 may be electrically conducted due to being connected by the each of the linking assemblies 130.

Specifically, the elastic member 132 is disposed in the sleeve 131, and the two rods 133 respectively penetrate through two opposite ends of the sleeve 131, wherein when the base 110 is not yet subjected to an external force, each of the rods 133 abuts against the elastic member 132 and the corresponding first contact point 114. On the other hand, the distance D3 between the two first contact points 114 disposed opposite to each other is greater than the distance D4 between the two second contact points 115 disposed opposite to each other, and a distance between any point on the guiding slope S12 that is close to the first contact point 114 and the opening S11 is greater than a distance between any point on the guiding slope S12 that is far away from the first contact point 114 and the opening S11 (namely, the guiding slope S12, for example, obliquely extends from the first contact point 114 towards the opening S11 and to the second contact point 115); and therefore, when the two rods 133 of each of the linking assemblies 130 move from the two first contact points 114 to the two second contact points 115 of the corresponding pivoting portion 112, each of the rods 133 would structurally interfere with the guiding slope S12, thereby moving towards the elastic member 132 and pressing the elastic member 132, simultaneously.

Next, after each of the rods 133 is abutted against the corresponding second contact point 115 so as to enable the two conductive terminals 116 within the two second contact points 115 to be electrically conducted due to being connected by the linking assembly 130 and to simultaneously generate the electrical signal, each of the rods 133 is pushed by an elastic restoring force of the corresponding elastic member 132 to reset to the corresponding first contact point 114 along the guiding slope S12. At this moment, under the condition that the two second contact points 115 disposed opposite to each other are not electrically conducted due to being connected by the linking assembly 130, no electrical signal would be generated, and thus the wearable electronic device 100 may stop executing the power switching function, the volume adjustment function, the screen switching function, the video image recording function, the sound recording function, or Bluetooth device searching and matching functions. Until the user apply a force to the bottom of the base 110 again, each of the linking assemblies 130 may be driven to move to the two corresponding second contact points 115, so that when the two second contact points 115 disposed opposite to each other are electrically conducted due to being connected by the each of the linking assemblies 130 and thereby simultaneously generate the electrical signal, the wearable electronic device 100 may again execute the previously mentioned operational functions.

The above embodiment mainly describes the actuating mechanism of the wearable electronic device 100 under the condition that the bottom of the base 110 is subjected to an external force F (such as when the user pushes the bottom surface 111*a* of the carrier 111 by the wrist or other wearing parts), but the invention is not limited thereto. In below, other embodiments will be provided for describing the invention. The following embodiment has adopted reference numerals and part of the contents from the previous embodiment, where the same reference numerals are used for representing the same or similar components, and descriptions of the same technical contents are omitted. The descriptions regarding the omitted part may be referred to the previous embodiment, and thus are not to be repeated herein.

Figure 7:
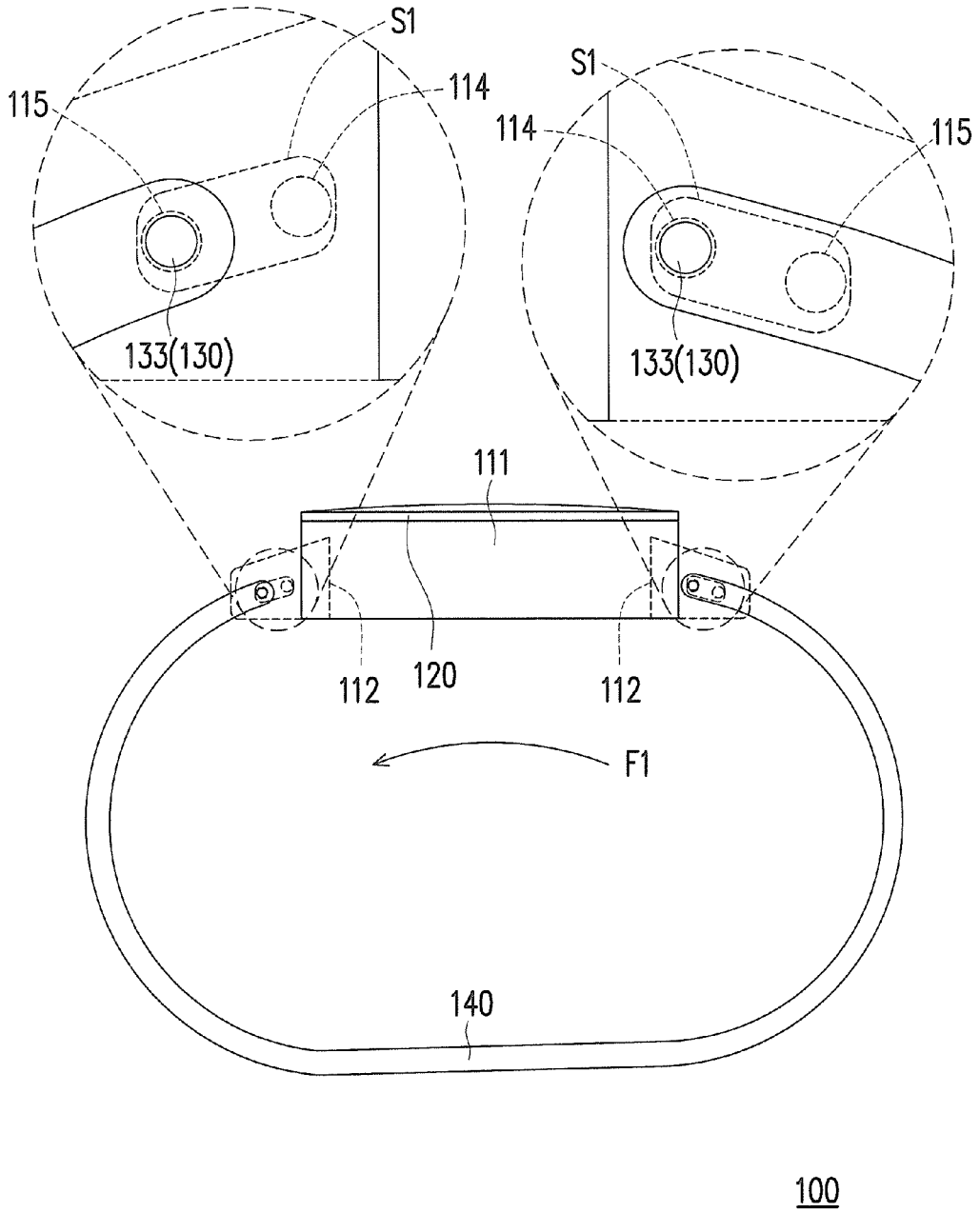
FIG. 7 is a side view of the wearable electronic device shown in FIG. 2 after it is subjected to another external force.
Figure 8:
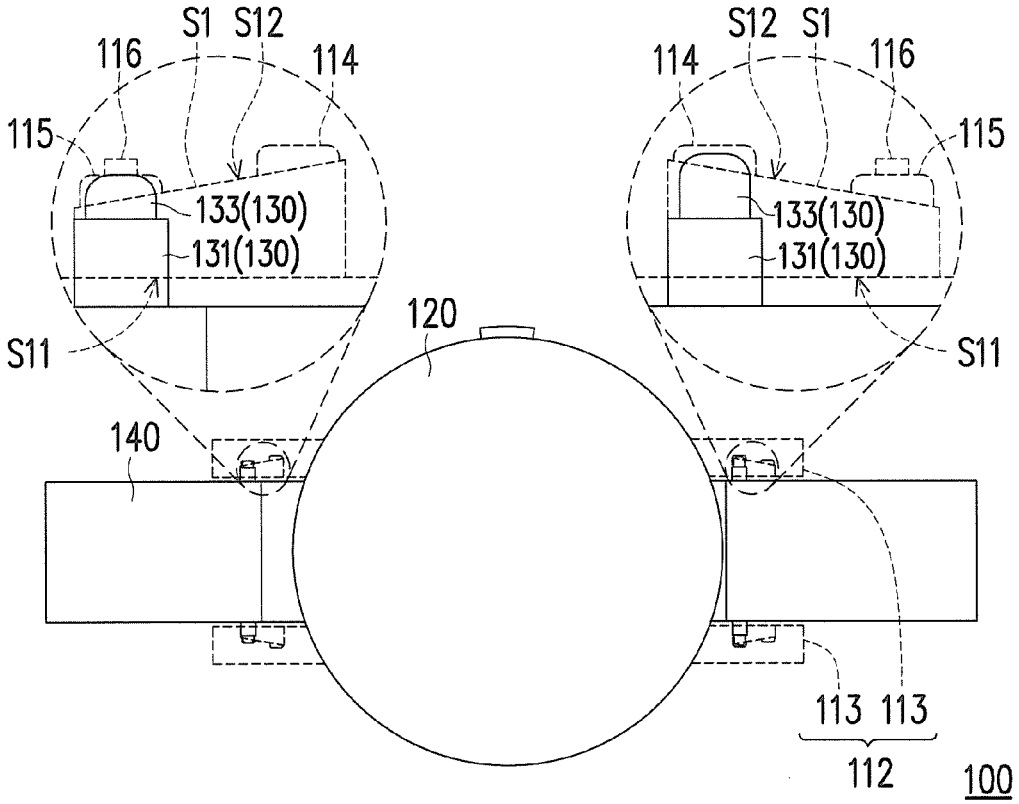
FIG. 8 is a top view of the wearable electronic device shown in FIG. 7.

FIG. 7 is a side view of the wearable electronic device shown in FIG. 2 after it is subjected to another external force. FIG. 8 is a top view of the wearable electronic device shown in FIG. 7. Referring to FIG. 7 and FIG. 8, in the present embodiment, the user may apply an external force F1 on the base 110 by means of swinging the wrist or the other wear parts. At this moment, the base 110 may actuate relative to the wearable element 140, wherein one of the linking assemblies 130 as limiting by the sliding rail S1 and is continuously coupled to two first contact points 114 of the corresponding pivoting portion 112, while the other one of the linking assemblies 130 as being guided by the sliding rail S1 moves from the two first contact points 114 to the two second contact points 115 of the corresponding pivoting portion 112. As such, one of the sets of the two second contact points 115, which are disposed opposite to each other, of the wearable electronic device 100 may also be electrically conducted due to being connected by the corresponding linking assembly 130 and may simultaneously generate an electrical signal, wherein the electrical signal may be transmitted to the body 120, so that the processing unit (not shown) within the body 120 may output a control signal according to the electrical signal, so as to execute functions, such as power switching, volume adjustment, screen switching, video image recording, sound recording, or Bluetooth device searching and matching.

In summary, the wearable electronic device of the invention may use the linking assemblies to couple the wearable element to the pivoting portions of the base, wherein after the base of the wearable electronic device is subjected to the external force, the base may actuate relative to the wearable element so as to enable the linking assemblies to move from the first contact points disposed opposite to each other to second contact points disposed opposite to each other on the pivoting portions. At this moment, the conductive terminals within the second contact points disposed opposite to each other may be electrically conducted due to being connected by the linking assemblies, and may simultaneously generate the electrical signal. Moreover, since the conductive terminals are electrically connected with the body, the electrical signal may be transmitted to the body, so that the processing unit within the body may output the control signal according to the electrical signal for executing the power switching function, the volume adjustment function, the screen switching function, the video image recording function, the sound recording function, or the Bluetooth device searching and matching functions. As a result, in addition to operating the wearable electronic device through using the physical keys or the virtual buttons, the user may also statically or dynamically operate the wearable electronic device easily through using the gesture changes or the postural changes of the other wearing parts, thereby enhancing the flexibility and the convenience in use.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A wearable electronic device, comprising:

a base, having a carrier and two pivoting portions located at two opposite sides of the carrier, wherein each of the pivoting portions has two first contact points disposed opposite to each other and two second contact points disposed opposite to each other;

a body, disposed on the carrier;

two linking assemblies; and a wearable element, having two opposite end portions, wherein each of the linking assemblies penetrates through the corresponding end portion, and each of the end portions of the wearable element is coupled to the two first contact points of the corresponding pivoting portion through the corresponding linking assembly, and when the base is subjected to an external force, at least one of the linking assemblies moves from the two first contact points to the two second contact points of the corresponding pivoting portion, and wherein at least one of the pivoting portions further has two conductive terminals electrically coupled to the body and respectively disposed within the two second contact points disposed opposite to each other, so that when at least one of the linking assemblies moves to the two second contact points disposed with the two conductive terminals, the two conductive terminals within the two second contact points are adapted to be electrically conducted due to being connected by the at least one of the linking assemblies.

2. The wearable electronic device as recited in claim 1, wherein each of the pivoting portions has two sliding rails disposed opposite to each other, each of the first contact points and each of the second contact points are located in the corresponding sliding rail, and each of the second contact points is farther away from the carrier than the corresponding first contact point.

3. The wearable electronic device as recited in claim 2, wherein each of the sliding rails has an opening and a guiding slope opposite to the opening, the guiding slope connects the first contact point and the second contact point, and a distance between the first contact point and the opening is greater than a distance between the second contact point and the opening.

4. The wearable electronic device as recited in claim 1, wherein a distance between the two first contact points disposed opposite to each other is greater than a distance between the two second contact points disposed opposite to each other.

5. The wearable electronic device as recited in claim 4, wherein each of the linking assemblies comprises:

a sleeve;

an elastic member, disposed in the sleeve;

two rods, respectively passing through two opposite ends of the sleeve, each of the rods abuts against the elastic member and the corresponding first contact point.

6. The wearable electronic device as recited in claim 5, wherein when the two rods of the at least one of the linking assemblies moves from the two first contact points to the two second contact points of the corresponding pivoting portion, the two rods move towards the elastic member and press the elastic member, simultaneously.

7. The wearable electronic device as recited in claim 6, wherein when each of the rods is abutted against the corresponding second contact point, due to being pushed by an elastic restoring force of the corresponding elastic member, each of the rods is reset to the corresponding first contact point.

8. The wearable electronic device as recited in claim 1, wherein a distance between each of the first contact points and a bottom surface of the corresponding pivoting portion is greater than a distance between each of the second contact points and the bottom surface of the corresponding pivoting portion.

9. The wearable electronic device as recited in claim 1, wherein the wearable element comprises a rubber strap, a metal strap or an elastic strap.

* * * * *